US006640369B1

(12) United States Patent
Malvasio

(10) Patent No.: US 6,640,369 B1
(45) Date of Patent: Nov. 4, 2003

(54) MULTI-FUNCTION PAINTER'S TOOL

(76) Inventor: William A. Malvasio, 2523 N. Lake Dr., #1, Milwaukee, WI (US) 53211

( * ) Notice: Subject to any disclaimer, the term of this patent is extended or adjusted under 35 U.S.C. 154(b) by 0 days.

(21) Appl. No.: 10/171,674

(22) Filed: Jun. 17, 2002

(51) Int. Cl.[7] ..... B44C 7/00
(52) U.S. Cl. ..... 7/105; 7/151; 7/169; 15/105
(58) Field of Search ..... 7/105, 151, 167, 7/169, 170; 15/105, 236.03, 236.07, 236.08; D8/34, 105, 14

(56) References Cited

U.S. PATENT DOCUMENTS 4,287,631 A * 9/1981 Marrs ..... 15/105
4,324,018 A * 4/1982 Olsson ..... 15/236.03
5,272,782 A * 12/1993 Hutt ..... 15/105
D386,372 S * 11/1997 Weiss ..... D8/14
6,421,860 B1 * 7/2002 Abbott ..... 7/105
6,427,274 B1 * 8/2002 Abbott ..... 7/105

FOREIGN PATENT DOCUMENTS

GB 2270464 A * 3/1994 ..... A46B/17/06

* cited by examiner

*Primary Examiner*—Joseph J. Hail, III
*Assistant Examiner*—David B. Thomas
(74) *Attorney, Agent, or Firm*—Arthur J. Hansmann

(57) ABSTRACT

A painter's tool having multiple tool elements of a paint brush comb, a paint roller scraper, a scraper blade, and a container cover remover. One end of the tool has a hook for suspending the tool from a horizontal support and to thereby support a paint can suspended from the tool. The tool can be made of one material, and it is preferably rigid throughout its entirety and presents a handle for maneuvering the tool in its multi-functions.

6 Claims, 3 Drawing Sheets

MULTI-FUNCTION PAINTER'S TOOL

This invention relates to a multi-function painter's tool, and, more particularly, it relates to a tool useful in the various functions of releasing the sealed cover of a plastic pail, combing a paint brush, scraping paint from a roller, and scraping pliable material onto a surface such as putty, plaster, spackling and the like.

BACKGROUND OF THE INVENTION

The prior art is already aware of painter's tools and the like for performing various functions useful to the painter. One of those functions is the releasing of a sealed cover from a plastic container, along with the aforementioned functions. In those prior tools, such as those cited in the filings herein, there is a claw or hook which attaches to the pail cover for prying the cover off the pail. Also, there are paint brush combs, paint roller scrapers, and putty knife items for scraping and applying pliable material.

The present invention improves upon the prior art by providing a multi-function tool that combines into only one tool all the elements for performing the various aforementioned functions, and doing so with optimum positioning of the elements relative to a handle, for maneuvering all the elements thereon. Thus, there is a solid handle which presents leverage for a claw for releasing a pail cover, and the handle supports a paint brush comb, a paint roller scraper, and a putty scraper.

Additionally, the present invention provides a multi-function painter's tool which includes a hook at one end of the handle opposite the location of the claw which is at the handle other end. With that arrangement, the tool can be suspended by its hook from a ladder rung or like horizontal support, and a paint can bail can latch onto the claw to thereby suspend the paint can from the support.

In the aforementioned suspension, the paint brush comb and the paint roller scraper are preferably disposed directly above the paint can so the excess paint from both the comb and the scraper falls into the can below. Thus, there is a clean function and there is a reduction of the amount of the paint, and the paint brush and the paint roller will retain only a minimal amount of paint and therefore avoid both a waste of paint and a crusting of paint on the paint brush and the paint roller. That improves upon the usual painter's practice of scraping the brush against the can rim where the surplus paint messes the rim. The comb and the roller scraper are both available for their respective functions when the tool is not mounted on a ladder rung and instead the tool handle by itself is being held.

The tool of this invention is preferably of only one piece of material, preferably elastic, which is sturdy and easily cleaned of paint. It is arranged with considerable beam strength for exerting a large torque, such as onto a pail cover for the release prying, and the hook is available for presenting additional leverage in the torquing action. The hook is also located to have the suspended can in the upright position off the ladder rung or like horizontal support.

BRIEF DESCRIPTION OF THE INVENTION

DETAILED DESCRIPTION OF THE PREFERRED EMBODIMENT

Figure 2:
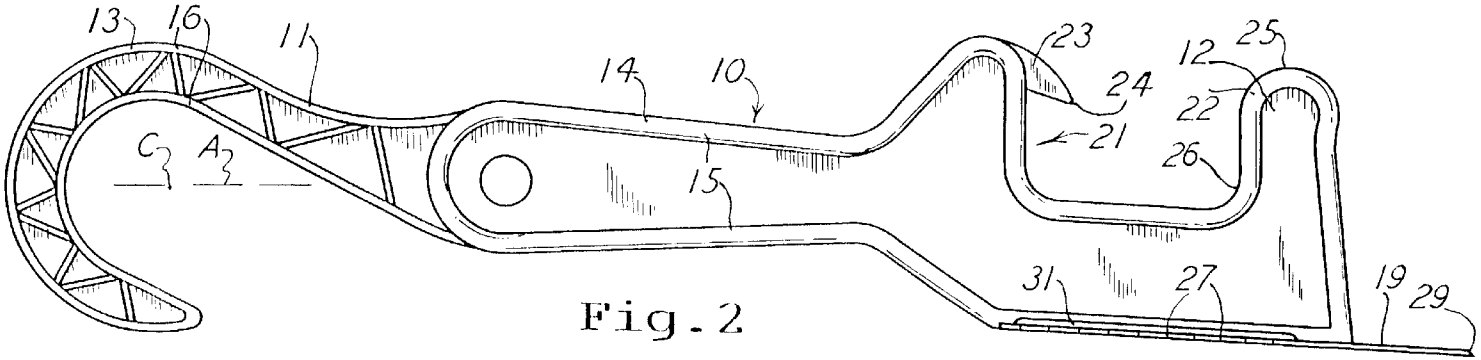
FIG. 2 is a side elevational view of FIG. 1.
Figure 4:
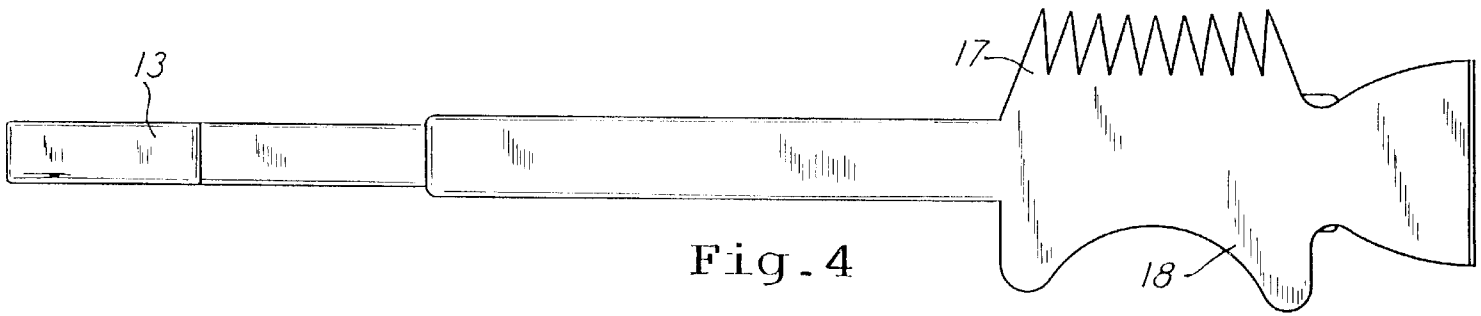
FIG. 4 is a bottom plan view of FIG. 2.
Figure 7:
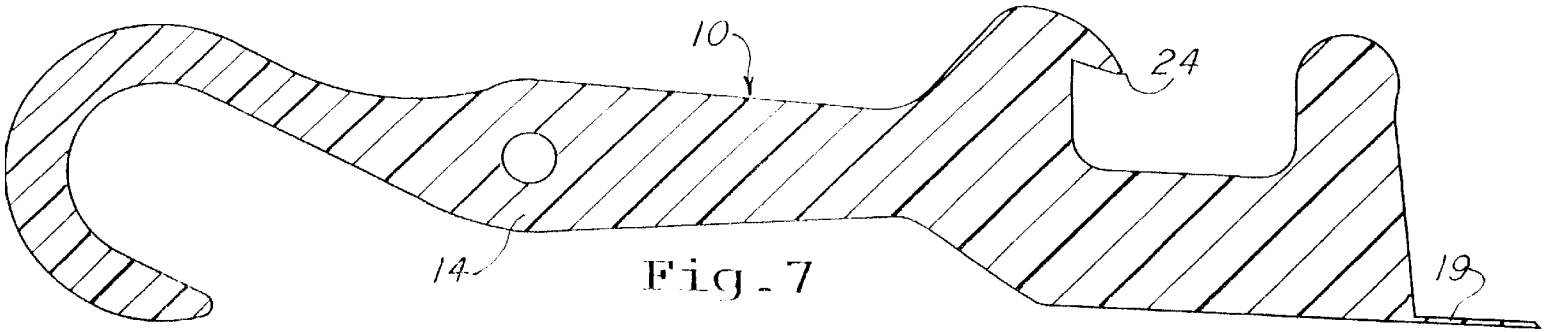
FIG. 7 is a sectional view taken on the plane designated by the line 7—7 of FIG. 3.
Figure 5:
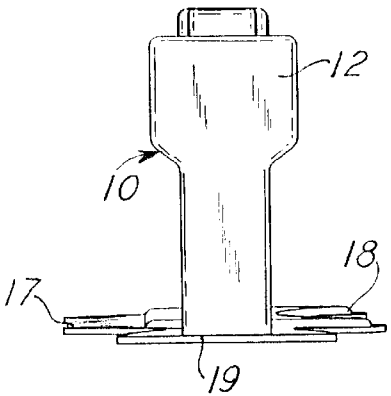
FIG. 5 is a right end elevational view of FIG. 1.
Figure 6:
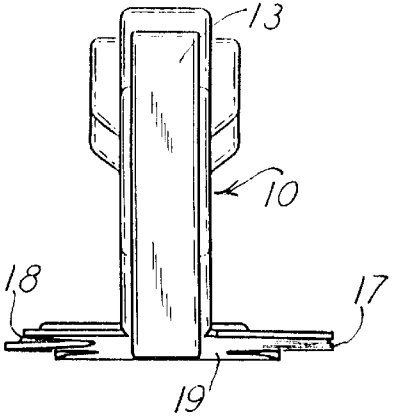
FIG. 6 is a left end elevational view of FIG. 1.

The multi-purpose tool of this invention preferably integrally presents an elongated handle 10 having a first terminal end 11 and a second terminal end 12. The end 11 presents a semi-circular hook 13, which, as seen in FIG. 2, can have its center of curvature at C and on the center of gravity longitudinal axis A of the handle 10.

It will be noted that the entire tool is preferably of an upright cross-sectional I-beam configuration throughout its length, as shown, and the main handle portion 14 can have a bead or foot 15 on both sides of the portion 14. The tool 10 can have its remaining handle portion 11 with its bead or foot portion 16, all for strength during the application of optimum torquing force through the tool which may be made of plastic. The hook 13 can have its foot or bead 16 extending therearound on both sides for strength.

The terminal end 12 can have four functional tools, namely, a paint brush comb 17, a paint roller scraper 18, a putty or the like scraper 19, and a container cover remover claw 21. Those four tools are preferably integral with the handle 10. The entire tool 10 can be made in a single molding process, both for sturdiness and economy of production.

Figure 1:
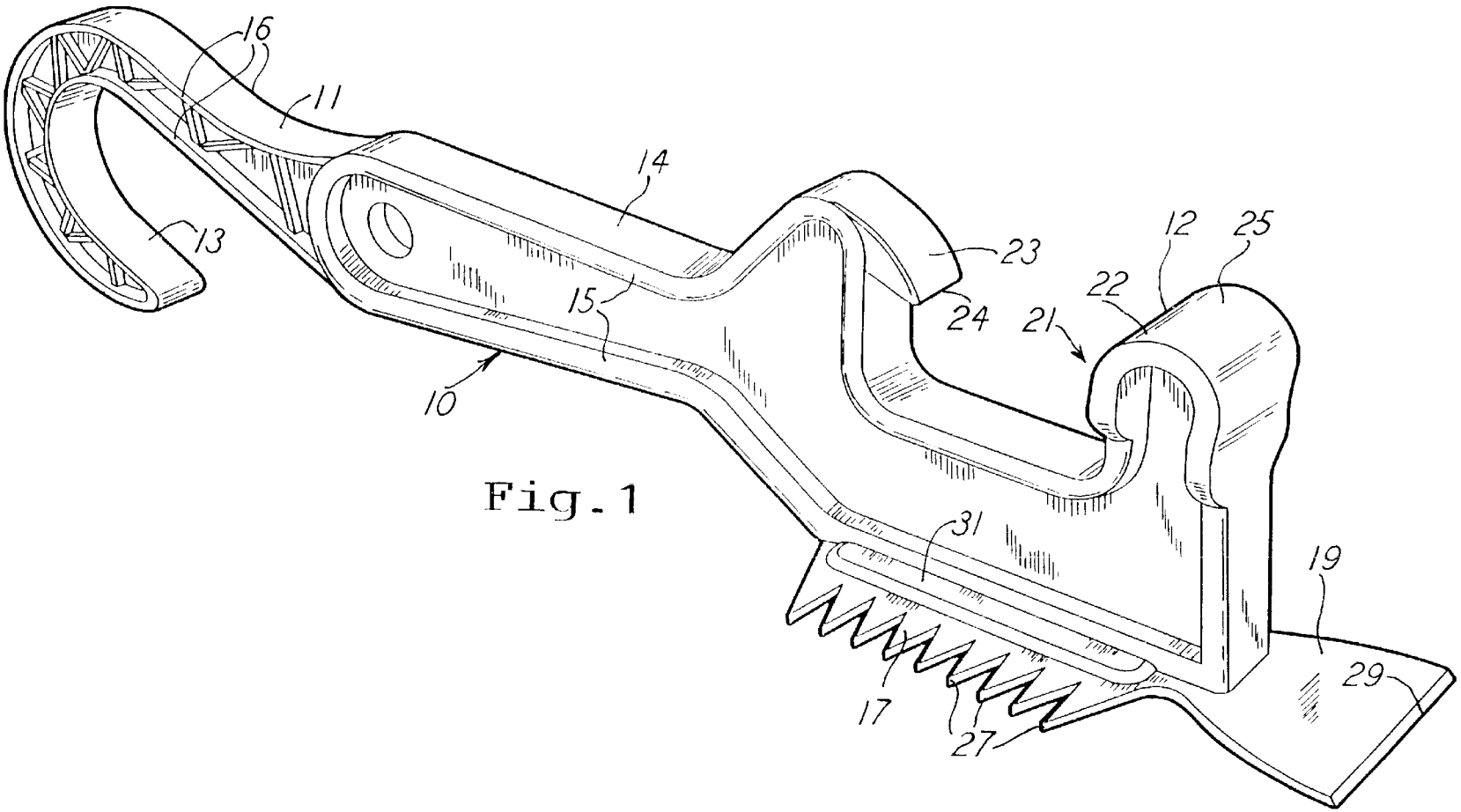
FIG. 1 is a perspective view of an embodiment of the tool of this invention.
Figure 3:
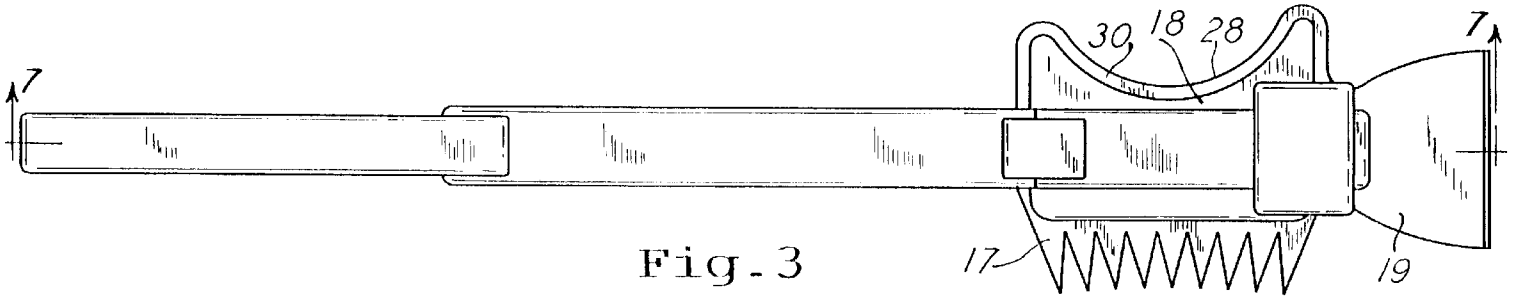
FIG. 3 is a top plan view of FIG. 2.

The claw or cover remover portion 21 can include an abutment 22 and a prier 23 which is pointed as at 24. The portion 21 and abutment 22 are preferably spaced apart, as shown, for straddling the rim of a plastic cover. It should be understood that the cover remover tool herein is maneuvered by placing it upside down from the position seen in FIGS. 1 and 2 to have the portion 22 on top of the can cover while the point 24 is disposed under the edge of the cover which is then pried up by lifting on the handle end 11. Such is a usual application of a cover remover, as seen in the references cited herein. The hook 11 is made available for presenting maximum leverage in the prying action. Also, the claw 21 is of a sufficient thickness of at least substantially one-half inch, that is along the edge 24, so that it will not cut through and thus shear the cover in the prying action. The abutment 22 has an arcuate surface 25, preferably of the greatest thickness on the tool 10, presenting a fulcrum for securely pivoting on the top of the cover being released.

It will also understood the hook 11 can be placed over a horizontal support, such as the rung of a ladder, and the remainder the tool 10 will then be suspended from and directly beneath the ladder rung, and a bail handle of a paint container (unshown) can be suspended from the handle portion 22. The handle bail. can then be in contact with the surface 26 of the abutment 22. With the hook 11 located as shown in FIG. 2, the suspended paint can will be vertically suspended to be upright and directly under the tool 10. Suspensions of paint cans are generally shown in the citations herein, and are known to those skilled in the art.

The tool end 12 also has the paint comb 17, preferably with teeth 27, and the roller scraper 18, with its arcuate edge 28, both extending laterally from the tool 10 on opposite sides of the tool 10. The scraper 19 can extend longitudinally from the handle and it has a beveled terminal edge 29, lust as the other scraper 18 has a beveled terminal. edge 30. All three tools 17, 18, and 19 are preferably co-planar and integral in the tool 10 and of the same construction material, such as plastic, and they are located spaced from the fulcrum

25 and the prier 21 so that the claw can be applied as a pry tool to release the container cover without having any one of the three tools contact the cover. A reinforcing shelf 31 is preferably included for structurally reinforcing the comb 17, and that also supports the claw 21. The normal combing direction would be toward the reinforcement 31.

When the tool 10 is in the ladder or other support suspended position mentioned, the brush comb 17 and the roller scraper are directly over the unshown but suspended paint can, so the paint run-off will fall into the can. The comb 17 and the scraper 18 are also available for their intended uses when the tool 10 is not in the suspended position mentioned. It will be further noticed that the comb 17 and the roller scraper 18 and the material scraper 19 are all disposed on the same plane, at what can be termed the bottom of the tool 10, and the comb 17 and scraper 18 are on laterally opposite sides of the handle. Also, the comb 17 and the scrapers 18 and 19 are disposed to one side of the axis A while the claw 21 is to the side opposite that one side, as the tool 10 is viewed from the side, such as in FIG. 2.

In sum, there is the multi-purpose tool with up to five functions, the tool is compact, can made of one material, is sturdy and has its individual tools arranged for optimum convenience and efficiency in their respective uses and relative to the handle body 14.

While only one embodiment is disclosed herein, it should be apparent to one skilled in the art that changes could be made relative to that embodiment. The scope of this invention should construed according to the claiming herein.

What is claimed is:

1. A multi-purpose painter's tool comprising:

a handle made of one plastic material and being one rigid piece and being elongated along a longitudinal axis and having a first terminal end and a second terminal end and a first side and a second side oppositely disposed on said handle on opposite sides of said axis, said first terminal end having a paint brush comb on said first one of said sides and a paint roller scraper on said second one of said sides, said second terminal end having its elongated shape for gripping in maneuvering said tool in combing the paint brush and in scraping the paint roller, a claw on said first terminal end for removing a cover from a container, and a hook of a semi-circular shape on said handle at said second terminal end and having a center of curvature on said longitudinal axis for suspending said tool from a horizontal support for supporting a paint can suspended by said claw.

2. The multi-purpose painter's tool as claimed in claim 1, wherein:

said claw is arranged for prying the cover in the removal thereof and has a thickness of at least one-half inch to thereby avoid shearing the cover upon prying.

3. The multi-purpose painter's tool as claimed in claim 2, wherein:

said handle having third and fourth sides relative to and on opposite sides of said axis and said claw is disposed on said handle at said third side of said handle and said comb and said scraper are disposed on said handle spaced from said claw at said fourth side of said handle to thereby permit said claw to pry the cover without having either said comb or said scraper contact said the cover.

4. The multi-purpose painter's tool as claimed in claim 3, wherein:

said comb arid said scraper extend laterally and respectively on said first and said second opposite sides of said handle and are fully disposed on the same lateral plane.

5. A multi-purpose painter's tool comprising:

a handle made of one material and being one rigid piece and being elongated and having a first terminal end and a second terminal end and a first side and a second side oppositely disposed on said handle, said first terminal end having a paint brush comb on said first one of said sides and a paint roller scraper on said second one of said sides, said second terminal end having its elongated shape for gripping in maneuvering said tool in combing the paint brush and in scraping the paint roller, said handle having a claw for hanging a paint can from said tool, and a hook integral on said second terminal end for hanging said tool from a horizontal support to thereby suspend said tool and the paint can from the support.

6. A multi-purpose painter's tool comprising:

a handle made of one material and being one rigid piece and being elongated and having a first terminal end and a second terminal end and a first side and a second side oppositely disposed on said handle, said first terminal end having a paint brush comb on said first one of said sides and a paint roller scraper on said second one of said sides, said second terminal end having its elongated shape for gripping in maneuvering said tool in combing the point brush and in scraping the paint roller, a claw on said first terminal end for prying a cover off container by applying leverage of said handle at said second terminal end, and a hook integral with said second terminal end for hanging said tool from a horizontal support to thereby suspend said tool and a container from the support.

* * * * *

UNITED STATES PATENT AND TRADEMARK OFFICE

CERTIFICATE OF CORRECTION

PATENT NO. : 6,640,369 B1
DATED : November 4, 2003
INVENTOR(S) : William A. Malvasio It is certified that error appears in the above-identified patent and that said Letters Patent is hereby corrected as shown below:

Title page,
Item [56], References Cited, U.S. PATENT DOCUMENTS, add the following:

| | | | |
|---|---|---|---|
| --259,245 | 6/1882 | Thomas | |
| 376,825 | 1/1888 | Kent | |
| 395,704 | 1/1889 | Kent | |
| 429,515 | 6/1890 | Fred | |
| 1,676,648 | 7/1928 | Hardiman | |
| 2,993,672 | 7/1961 | Bower | 248/211 |
| 4,053,131 | 10/1977 | Francis | 248/211 |
| 4,658,455 | 4/1987 | Skillern | 7/105 |
| 4,967,436 | 11/1990 | Russell | 7/156 |
| 5,069,090 | 12/1991 | Clark | 81/3.09 |
| 5,272,782 | 12/1993 | Hutt | 15/105 |
| 5,546,625 | 8/1996 | Mealey | 15/105 |
| 5,778,472 | 7/1998 | Lang | 7/156 |
| 5,956,788 | 9/1999 | Henke | 7/105 |
| 5,979,058 | 11/1999 | Henke | 30/143 |
| 6,009,581 | 1/2000 | Davis | 7/105 |
| 6,131,222 | 10/2000 | Anderson | 7/105 |
| 6,327,728 | 12/2001 | Hart | 7/105 |
| D174,896 | 6/1955 | Carter | D54/13 |
| D263,198 | 3/1982 | Boyd | D8/40 |
| D271,275 | 3/1983 | Richland | D8/2 |
| D276,304 | 3/1984 | DiFede | D8/40 |
| D285,900 | 9/1986 | Chan | D8/105 |
| D304,992 | 12/1989 | Matthies | D8/40 |
| D308,322 | 6/1990 | Borden | D8/40 |
| D359,220 | 6/1995 | Vinar | D8/105 |
| D382,453 | 8/1997 | Drinkwater | D8/14 |
| D386,372 | 8/1997 | Weiss | D8/14 |

UNITED STATES PATENT AND TRADEMARK OFFICE

CERTIFICATE OF CORRECTION

PATENT NO. : 6,640,369 B1
DATED : November 4, 2003
INVENTOR(S) : William A. Malvasio It is certified that error appears in the above-identified patent and that said Letters Patent is hereby corrected as shown below:

U.S. PATENT DOCUMENTS, cont'd,

| | | | |
|---|---|---|---|
| D386,859 | 8/1997 | Lawrence | D32/46 |
| D399,621 | 10/1998 | Henke | D32/49 |
| D405,668 | 2/1999 | Henke | D8/34 |
| D424,390 | 5/2000 | Denton | D8/45 |
| D435,154 | 12/2000 | Garon | D32/42 |
| D435,408 | 12/2000 | Panfili | D8/16 |
| D445,320 | 7/2001 | Abbott | D8/14 |
| D448,572 | 10/2001 | Graulee | D4/116 |
| D450,994 | 10/2001 | Abbott | D8/105-- |

Signed and Sealed this

Thirtieth Day of March, 2004

JON W. DUDAS
*Acting Director of the United States Patent and Trademark Office*